US010034499B2

(12) United States Patent
Blackshear

(10) Patent No.: US 10,034,499 B2
(45) Date of Patent: Jul. 31, 2018

(54) DISPOSABLE BIB SYSTEM

(71) Applicant: Walter W. Blackshear, Baytown, TX (US)

(72) Inventor: Walter W. Blackshear, Baytown, TX (US)

( * ) Notice: Subject to any disclaimer, the term of this patent is extended or adjusted under 35 U.S.C. 154(b) by 0 days.

(21) Appl. No.: 15/238,069

(22) Filed: Aug. 16, 2016

(65) Prior Publication Data

US 2018/0049487 A1 Feb. 22, 2018

(51) Int. Cl.
*A41B 13/00* (2006.01)
*A41D 13/04* (2006.01)
*A41B 13/10* (2006.01)

(52) U.S. Cl.
CPC ..... *A41D 13/04* (2013.01); *A41B 13/103* (2013.01); *A41B 2300/33* (2013.01); *A41B 2400/52* (2013.01)

(58) Field of Classification Search
CPC .. A41D 13/04; A41B 13/103; A41B 2300/33; A41B 2400/52
USPC ..... 2/48, 49.1, 49.2, 49.3, 49.5, 50
See application file for complete search history.

(56) References Cited

U.S. PATENT DOCUMENTS 1,963,130 A * 6/1934 Hall ..... A41B 13/10 2/49.1
2,250,887 A * 7/1941 Brown ..... A41B 13/10 2/49.2
2,525,115 A * 10/1950 Britton ..... A41B 13/10 2/49.2
3,093,829 A * 6/1963 Maine ..... A41D 13/04 2/457
3,146,464 A * 9/1964 Burnett ..... A41B 13/103 2/49.3
3,328,807 A * 7/1967 Strauss ..... A41B 13/103 2/49.3
3,332,547 A * 7/1967 Buss ..... A41B 13/10 2/49.1
3,407,407 A * 10/1968 Hollander ..... A41B 13/103 2/49.2
3,540,060 A * 11/1970 Brown ..... A41B 13/103 2/49.2
4,301,544 A * 11/1981 Burton ..... A41B 13/106 2/49.5
4,649,572 A * 3/1987 Roessler ..... A41B 13/103 2/49.2
4,797,952 A * 1/1989 Petrini ..... A41B 13/10 2/49.2
4,837,859 A * 6/1989 Hamberg ..... A41D 13/0537 2/1
4,924,527 A * 5/1990 Hintermeyer ..... A41B 13/103 2/46
5,220,692 A * 6/1993 Cox ..... A41D 13/04 2/46

(Continued)

*Primary Examiner* — Katherine Moran
*Assistant Examiner* — James Heracklis
(74) *Attorney, Agent, or Firm* — Law Office of Jeff Williams; J. Oliver Williams

(57) ABSTRACT

The present application includes a system and method for protecting the user's clothes from food stains. The system includes a neckpiece convenient to place around the user's neck, a flexible material to attach to the neckpiece and a pair of tabs which are placed on the user to form a pocket to catch food particles. The flexible material may be detached from the neckpiece, allowing the neckpiece to be reused.

16 Claims, 4 Drawing Sheets

(56) References Cited

U.S. PATENT DOCUMENTS 5,457,820 A * 10/1995 Yielding ..... A41B 13/106 2/49.1
5,504,941 A * 4/1996 Sell ..... A41B 13/103 2/247
5,530,968 A * 7/1996 Crockett ..... A41B 13/103 2/243.1
D383,891 S * 9/1997 Hill ..... D2/861
5,819,314 A * 10/1998 Jackson ..... A41B 13/10 2/243.1
5,956,763 A * 9/1999 Blackshear ..... A41B 13/106 2/46
6,209,133 B1 * 4/2001 Hinshaw ..... A41B 13/103 2/49.1
6,243,869 B1 * 6/2001 Ekovich ..... A41B 13/10 2/46
6,345,396 B1 * 2/2002 Schuler ..... A41D 13/0537 2/465
6,405,374 B1 * 6/2002 Giakas-Cano ..... A41B 13/10 2/49.1
6,490,731 B1 * 12/2002 Hyatt ..... A41B 13/103 2/49.1
D473,364 S * 4/2003 Conte ..... A41B 13/106 D2/860
D483,552 S * 12/2003 Hughes ..... D2/861
6,836,900 B1 * 1/2005 Fus, Sr. ..... A41B 13/10 2/49.1
D526,765 S * 8/2006 Lown ..... B65D 33/08 D2/860
7,269,855 B2 * 9/2007 LaRocco ..... A41B 13/103 2/49.1
7,761,930 B2 * 7/2010 Krause ..... A45F 5/02 2/48
D690,909 S * 10/2013 Albers ..... D2/864
D702,924 S * 4/2014 Baumgartner ..... D2/860
9,320,304 B1 * 4/2016 Sanders ..... A41B 13/103
9,386,806 B2 * 7/2016 Bailey ..... A41B 13/103
9,468,242 B1 * 10/2016 Lee ..... A41D 13/04
D781,531 S * 3/2017 Butler ..... D2/861
2006/0079855 A1 * 4/2006 Hooper ..... A41D 13/04 604/385.01
2007/0157357 A1 * 7/2007 Cymbol ..... A41B 13/103 2/49.2
2007/0199123 A1 * 8/2007 Friedland ..... A41B 13/10 2/49.1
2008/0172768 A1 * 7/2008 DeStefano ..... A41B 13/106 2/49.2
2010/0107294 A1 * 5/2010 Gillian ..... A41B 13/10 2/49.5
2011/0010816 A1 * 1/2011 Johnson ..... A41D 1/205 2/48
2012/0042431 A1 * 2/2012 Lee ..... A41D 13/04 2/48
2013/0086725 A1 * 4/2013 Sabre ..... A41B 13/10 2/49.2
2013/0161984 A1 * 6/2013 Yaghmai ..... A47D 15/00 297/135

* cited by examiner

DISPOSABLE BIB SYSTEM

BACKGROUND

1. Field of the Invention

The present application relates generally to protective clothing, and in particular to a disposable bib.

2. Description of Related Art

Fast food drive-through has topped 30 million buyers per day. Drive-through business accounts for 50-70% of a fast food establishment's revenue. Ketchup, mustard, grease and mayo are all common fast food elements that cause clothing stains.

Vehicle operators who eat while they drive use various methods to prevent food from falling on their clothes. One method spreads out the food wrapper, directing the sides upward to catch food. This may be done over a lap or across a portion of a vehicle. Another method relies on a bib used by the driver. In either case, the disadvantages are aplenty.

With the wrapper, the driver hunches over the wrapper while they eat. This act tends to distract the driver while driving, and during eating by having to ensure the food falls onto the wrapper. A further disadvantage is that wrappers are not secured in any way. They frequently slide or move at the slightest contact making it more difficult to ensure it stays where expected. Additionally, the upward directed sides frequently flex or fall when impacted by food making them less effective. Furthermore, wrappers are particularly located on the lap or away from the upper torso of a user. This means that blouses and shirts are fully exposed to falling food whether the wrapper works as planned or not.

One solution to food falling on clothes is wearing a bib. Existing bib designs generally require the inconvenience of tying bib strings behind the neck. A vehicle seat's headrest, positioned directly behind the user's head makes tying bib strings at the back of the neck difficult. Bib strings that tie around the back are also inconvenient in the cramped vehicle environment, as one does not have much room to tie a knot or link a fastener. The diminished range of arm motion due to age, arthritis or disability makes the task even more tedious. Bibs have been made to tuck into clothing in order to avoid the pitfalls of ties around the neck. However, tucking bibs into a shirt or blouse collar is a problem with V-neck and plunge cut clothing.

Additionally, conventional bibs are generally one size to fit all customers. This generally protects the torso in limited areas and tends to leave the lap exposed. A bib that is long enough to cover a lap, tends to drape and fall between the legs, defeating its purpose as it fails to catch and contain food particles. Likewise, they are difficult to handle and are heavier around the neck and clothing.

Although bibs have been improved, considerable shortcomings remain. Bibs are generally non-disposable, cannot be adjusted for length or shape and only fasten to the neck. The need exists for bibs that are well suited for traveling, bibs that: 1) can be secured to the user in a plurality of body locations, 2) permit custom contours and positions, and 3) are disposable.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
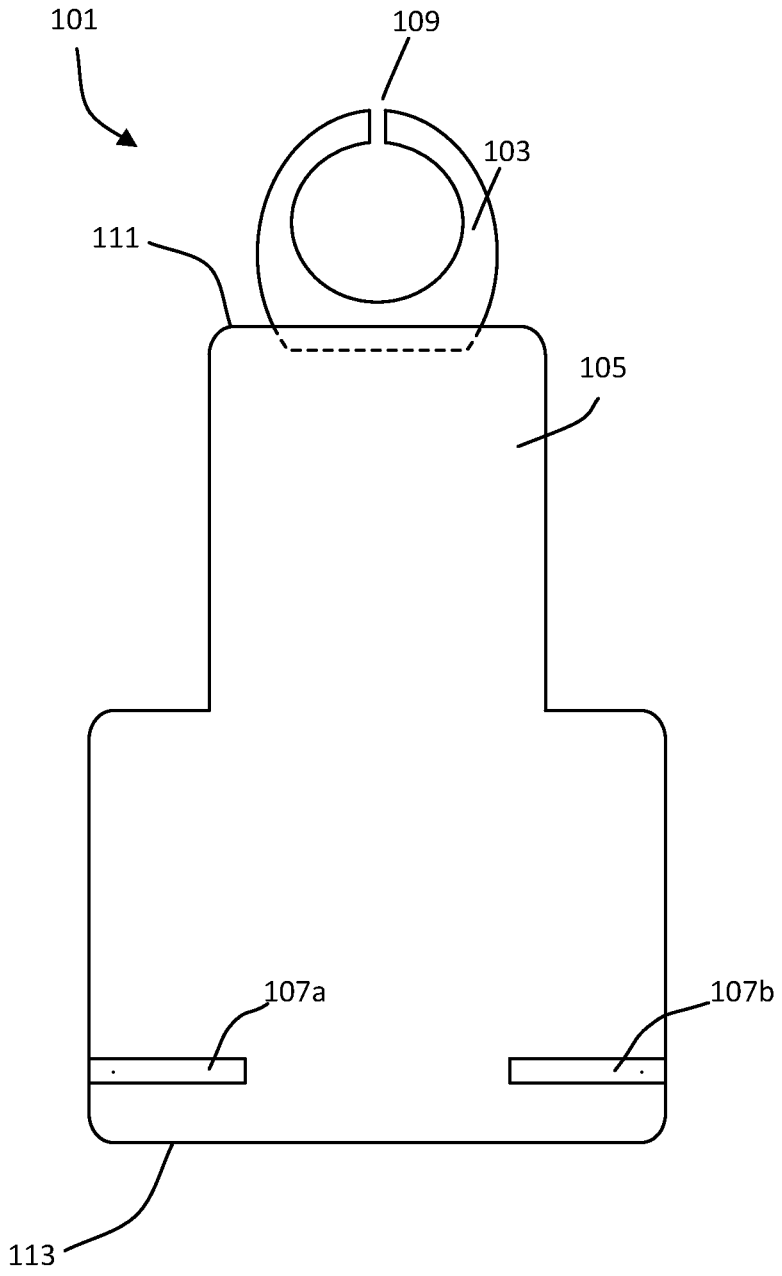
FIG. 1 is a front view of a disposable bib system according to an embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The system and method in accordance with the present application overcomes one or more of the above-discussed problems commonly associated with conventional bib systems. It is desired that a bib system be developed which is convenient to put on and remove while seated in a vehicle, protects clothing and catches food that drops while eating. The system and method secures the bib to the user in a variety of locations, permits the user to contour and shape the bib as needed to protect the user's clothes and is disposable. These and other unique features of the system and method are discussed below and illustrated in the accompanying drawings.

The system and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Figure 2:
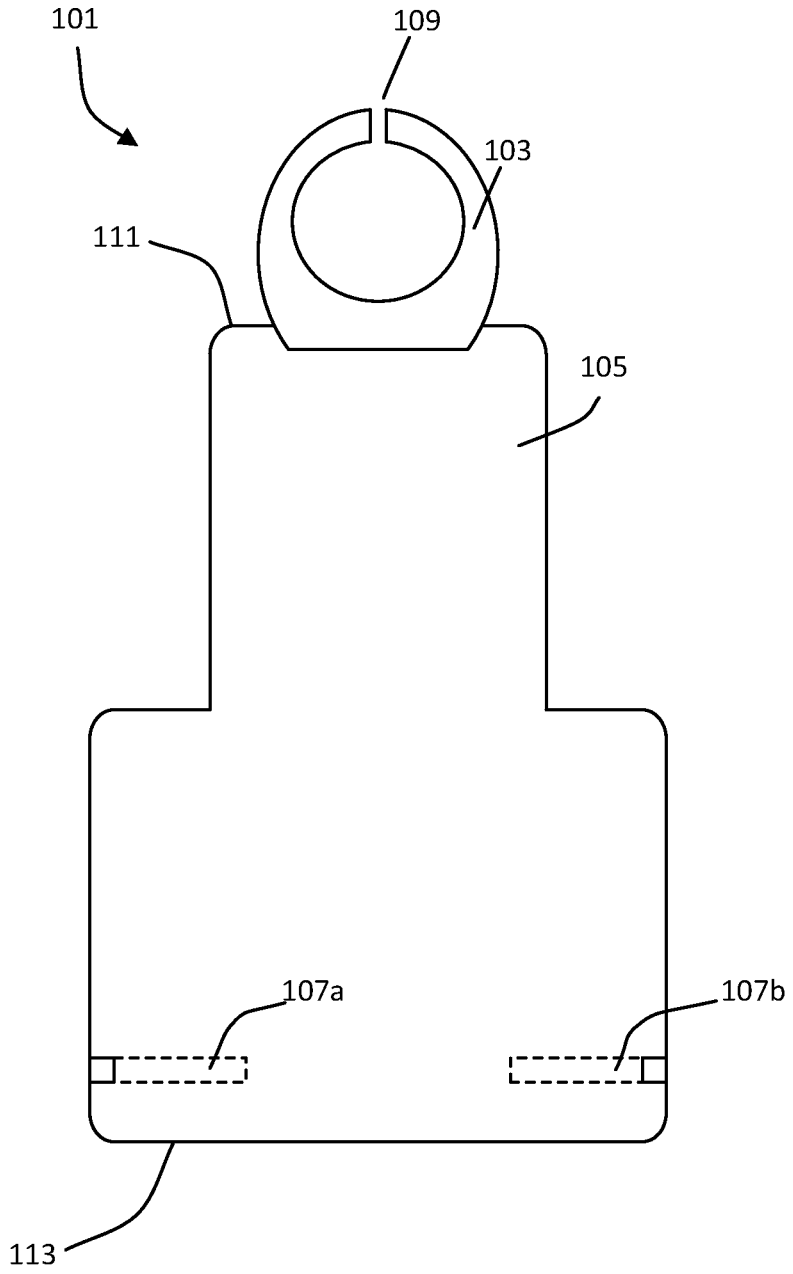
FIG. 2 is a back view of the disposable bib system of FIG. 1.

Referring now to the drawings wherein like reference characters identify corresponding or similar elements in form and function throughout the several views. FIGS. 1 and 2 illustrate a bib system of the present application. The bib system 101 is configured to be secured to the user in a plurality of body locations, permit custom contours and positions, and is disposable.

System 101 comprises a neckpiece 103, a flexible material 105, and a plurality of tabs 107*a* and 107*b*. Neckpiece 103 holds flexible material 105 under the chin of the user. A gap 109 in the neckpiece allows the neckpiece 103 to flex for placement around the neck of the user. Neckpiece 103 is generally made of paperboard, which may be laminated to enhance durability. Alternatively, neckpiece 103 may also be made of other materials, for example, plastic or material with a wire frame.

Flexible material 105, adjacent to a proximal end 111, couples to neckpiece 103 and is configured to cover a portion of the user's anterior torso and legs. Flexible material 105 protects the user from food spills, allowing the user to fold and contour flexible material 105 for best protection. An example of flexible material 105 is an absorbent non-woven fabric. Another example of flexible material 105 may include a woven, absorbent fabric backed a with non-absorbent layer to prevent food soaking through. A plurality of layers may be used to both prevent the liquids from soaking through, but also prevent liquids from coming into contact with shirt or blouse sleeves.

The plurality of tabs 107, coupled to flexible material 105 and adjacent to a distal end 113, are configured to open up from the bib's front surface and selectively extend laterally out to couple to the user using an adhesive applied to tabs 107. When extended laterally out, the adhesive is facing forward away from the user. The adhesive is used to permit for the repeated securing and releasing of flexible material 105 to the user.

Figure 3:
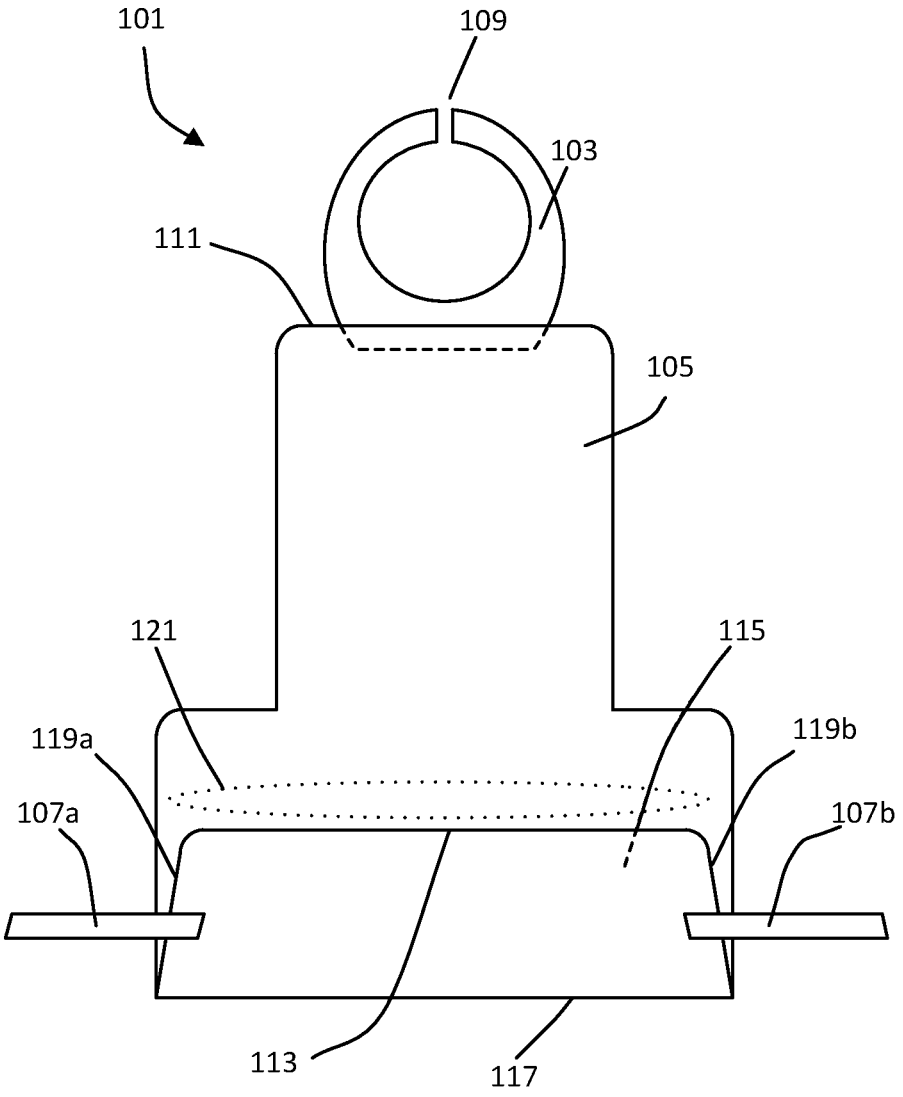
FIG. 3 is an alternative front view of the disposable bib system of FIG. 1.

Referring now also to FIG. 3, an alternative front view of system 101 is illustrated. Securing flexible material 105 may be done in a couple different methods. A user is able to use the adhesive on tabs 107 or may elect to place tabs 107 between a vehicle seat and the user's body. To use the adhesive, flexible material 105 is folded to form a pocket 115. Tabs 107 are selectively extended laterally. When flexible material 105 is folded, the adhesive on tabs 107 are oriented such that it faces the user. Tabs 107 are moved toward proximal end 111, creating a fold 117 in flexible material 105. A pocket opening 121 is generated and defined as the empty space formed between distal end 113 and flexible material 105. Pocket 115 is the empty space between pocket opening 121, fold 117 and pocket sides 119*a* and 119*b*. Pocket 115 is configured to catch falling food particles. The user may customize the size of pocket 115 based on the user's posture and physical characteristics, by selectively coupling tabs 107 to the user at any relative distance to proximal end 111. For example, where space is limited or the gut size of the user is large, tabs 107 may be raised close to proximal end 111 and the adhesive secured to the shirt of the user. The user may remove tabs 107 from the clothing and reposition as necessary. Tabs 107 also permit the user the ability to affect the contour of pocket 115 by regulating the tauntness of distal end 113.

Figure 4:
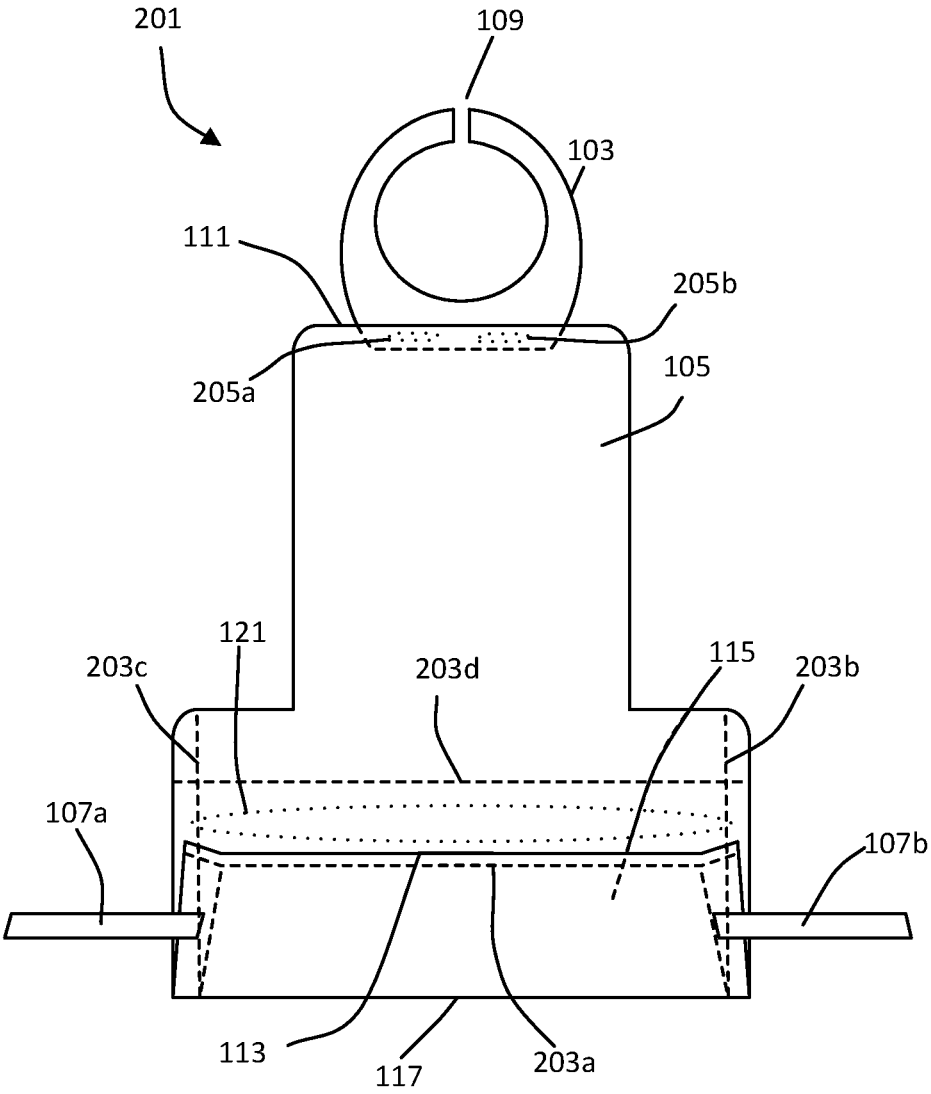
FIG. 4 is a front view of an alternative embodiment of the disposable bib system of FIG. 3.

Referring now to FIG. 4, a front view of an alternative embodiment of the disposable bib system 101 of FIG. 3 is shown. Disposable bib system 201 is similar in form and function to bib system 101 except as herein described. System 201 further comprises one or more form holding strips 203 coupled to material 105, which are seen in FIG. 4 as 203*a*, 203*b*, 203*c*, and 203*d*. Strips 203 are located along edges or across flexible material 105 in any type of pattern or length. Strips 203 allow the user to contour flexible material 105 to the user's body and to make pocket opening 121 larger, enhancing the capture of food particles. Strips 203 are configured to add additional rigidity and stability to edges 119*a*, 119*b*, edge 113 and material 105. Strips 203 are usually metallic wires that hold their form when bent. Alternative materials that hold their form after being bent, such as polymers and plastics, may also be used. Strips 203 are coupled to flexible material 105, usually using adhesive. Other examples of coupling strips 203 to material 105 include being sewn in or incorporated into material 105 during its manufacture. Form holding strips 203*a*, 203*b*, 203*c* and 203*d* may be used singly or in combination.

In other embodiments, neckpiece 103 may be releasingly coupled to material 105 utilizing one or more fasteners 205, which are seen in FIG. 4 as 205*a* and 205*b*. By releasing neckpiece 103 from material 105, the user can reuse neckpiece 103, obtain a new flexible material 105 and couple it to neckpiece 103. Examples of fastener 205 include, but are not limited to, releasable adhesive, snap, hook and loop and clip.

The current application has many advantages over the prior art including at least the following: 1) the bib can be secured to the user in a plurality of body locations, 2) permitting custom contours and positions to enhance the protection of users clothing, and 3) the bibs are disposable.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A disposable bib, comprising:

a neckpiece formed with a central aperture and a gap extending from an outer edge of the neckpiece to the central aperture, the gap permitting the neckpiece to partially separate thereby enabling the user to place the neckpiece around their neck, the central aperture wrapping around a user's neck;

a flexible material coupled to the neckpiece and configured to cover at least a portion of the user's body, the flexible material having a distal end opposite the neckpiece, the material of the flexible material being different from that of the material forming the neckpiece;

a plurality of tabs coupled to the flexible material, each tab having a first end and a second end, the first end and the second end being coupled to a front surface and a back surface of the flexible material, the first end being partially detachable from the front surface and the second end being securely fastened to the back surface such that the plurality of tabs selectively fold around an edge of the flexible material, the plurality of tabs configured to alternate between a first position and a second position, the first position having both the first end and the second end coupled to the front surface and the back surface of the flexible material, the second position having the first end selectively extended outward laterally beyond the perimeter of the flexible material and the second end coupled to the back surface, the plurality of tabs having an adhesive applied to the first end in communication with the front surface such that when extended the adhesive faces the same direction as the front surface of the bib, thereby being configured to secure the distal end in an elevated position such that the flexible material is folded over onto itself.

2. The disposable bib of claim 1, the neckpiece is configured to flex around the neck.

3. The disposable bib of claim 1, wherein the plurality of tabs are located near a distal end of the flexible material.

4. The disposable bib of claim 1, wherein the flexible material is removable from the neckpiece.

5. The disposable bib of claim 1, wherein a proximal end of the flexible material further comprises a fastener, enabling the user to couple the flexible material to the neckpiece.

6. The disposable bib of claim 1, wherein the plurality of tabs releasingly couple to a portion of the user.

7. The disposable bib of claim 1, wherein attachment of the pair of tabs about the user creates a pocket formed in the flexible material.

8. The disposable bib of claim 7, wherein the size of the pocket is dependent on the attachment of the plurality of tabs on the user.

9. The disposable bib of claim 7, wherein the size of the pocket is adjustable.

10. The disposable bib of claim 7, wherein the pocket is configured to catch food.

11. The disposable bib of claim 7, further comprising a form holding strip coupled to the distal end of the flexible material, the form holding strip capable of being bent to hold the pocket open.

12. The disposable bib of claim 1, wherein the neckpiece is releasably coupled to the flexible material by a releasable fastener such that the flexible material may be replaced.

13. A method of using a disposable bib comprising the steps of:

obtaining a neckpiece having a central aperture and a gap extending from an outer edge of the neckpiece to the central aperture, the gap permitting the neckpiece to partially separate thereby enabling the user to place the neckpiece around their neck;

attaching a flexible material to the neckpiece, the flexible material having a distal end opposite the neckpiece, the material of the flexible material being different from that of the material forming the neckpiece;

operating a pair of tabs between a first position and a second position such that each tab partially detaches from the flexible material, each tab having a first end and a second end, the first end and the second end being coupled to a front surface and a back surface of the flexible material in the first position, the plurality of tabs selectively fold around an edge of the flexible material in the first position, the first end being partially detachable from a first side and the second end being securely fastened to a second side such that the first end detaches from the front surface and unfolds around the edge of the flexible material by partially extending away from the flexible material to expose an adhesive layer on each pair of tabs in the second position, the adhesive located on an upper face of the plurality of tabs so as to contact the front surface of the flexible material when in the first position, the adhesive facing the same direction as the front surface when in the second position;

securing the pair of tabs relative to the flexible material so as to elevate the distal end, the flexible material folding over itself such that the front face of the flexible material faces itself.

14. The method of claim 13 further comprising the step of folding the flexible material creates a pocket to catch food.

15. The method of claim 13 further comprising the step of folding the flexible material so as to adhere the tabs to the user.

16. The method of 14 further comprising the step of adjusting the size of the pocket.

* * * * *